US005628601A

United States Patent [19]

Pope

[11] Patent Number: 5,628,601

[45] Date of Patent: May 13, 1997

[54] OIL PAN BOLT WITH RETAINING MEANS

[76] Inventor: Robert Pope, 1177 Branham La., Ste. 279, San Jose, Calif. 95118

[21] Appl. No.: 583,885

[22] Filed: Jan. 11, 1996

[51] Int. Cl.[6] ..... F16B 35/02; F16L 55/10

[52] U.S. Cl. ..... 411/383; 411/392; 411/419; 411/999; 285/117; 138/89

[58] Field of Search ..... 411/392, 324, 411/383, 386, 369, 418, 419, 970, 999; 285/23, 117; 138/89

[56] References Cited

U.S. PATENT DOCUMENTS

| | | | |
|---|---|---|---|
| 2,053,918 | 9/1936 | Peretzman | 411/386 X |
| 2,225,205 | 12/1940 | Brooks | 138/89 X |
| 3,592,250 | 7/1971 | Petroschanoff | 411/999 X |
| 4,776,737 | 10/1988 | Wollar | 411/369 X |
| 4,810,148 | 3/1989 | Aisa et al. | 411/383 |
| 4,854,797 | 8/1989 | Gourd | 411/392 X |

FOREIGN PATENT DOCUMENTS

| | | | |
|---|---|---|---|
| 216380 | 10/1967 | Sweden | 411/340 |

*Primary Examiner*—Neill R. Wilson
*Attorney, Agent, or Firm*—The Kline Law Firm

[57] ABSTRACT

An oil pan bolt with a standard bolt head and a sealing flange that fits against the oil pan. Extending from the head of the bolt is a threaded portion that is inserted into the threads of the oil pan drain hole. An extension piece extends from the distal end of the threaded portion of the bolt. At a distal end of the extension piece is a retaining element. One way of forming the retaining element is to have another small threaded portion at the distal end of the extension piece.

6 Claims, 4 Drawing Sheets

OIL PAN BOLT WITH RETAINING MEANS

FIELD OF THE INVENTION

The present invention relates generally to automotive equipment, and more particularly is an oil pan bolt (or plug) with retaining means.

BACKGROUND OF THE INVENTION

Internal combustion engines use motor oil to lubricate their moving parts. The oil is collected in an oil pan when the engine is not in operation. In order to replace the oil in the engine after it has been used for some time, and has become contaminated with dirt and particulate matter, a means to drain the oil pan must be available. This means of draining is universally provided by means of a threaded drain hole on the underside of the oil pan. The drain hole is sealed with an oil pan bolt during operation of the engine.

In order to change the oil in an engine, the used oil must be drained from the engine. This is accomplished by removing the oil pan bolt from the drain hole, and allowing the oil to drain out into a receptacle. Traditionally, this has involved the oil changer getting his hand covered with hot oil.

Oil drains best when it is heated and therefore less viscous. Oil is therefore usually changed after the engine has been operated so that the oil is heated. Most vehicle engines hold at least a gallon of oil, so the pressure on a drain hole is considerable. As the oil pan bolt is removed, the threads of the plug leave the threads of the drain hole. Once the bolt is out of the hole, hot oil gushes out of the oil pan, usually covering the operator's hand.

This very often results in the oil pan bolt being knocked out of the operator's hand and into the receptacle for the used oil. Thus in addition to the initial hot oil bathing, the operator is provided the opportunity to retrieve the oil pan bolt from the bottom of the used oil receptacle.

In addition to it being nearly impossible to change oil without getting a handful of hot oil with the current art oil pan bolt, it is also extremely easy to misplace the plug during an oil change. Once the bolt is removed, it must be said aside while the oil drains. It is therefore quite common for an operator to kick the plug somewhere where it cannot be found. This necessitates a trip, in another vehicle, to an auto parts store to obtain another oil pan bolt to finish the oil change.

OBJECTS, SUMMARY, AND ADVANTAGES OF THE INVENTION

Accordingly, it is an object of the present invention to provide an oil pan bolt that includes a means to retain the bolt in the oil pan after the drain hole is opened.

It is a further object of the present invention to provide an oil pan bolt with retaining means that is inexpensive to manufacture and is easy to use.

In summary, the present invention comprises a bolt with a standard bolt head and a sealing flange that fits against the oil pan. Extending from the head of the bolt is a threaded portion that is inserted into the threads of the oil pan drain hole. An extension piece extends from the distal end of the threaded portion of the bolt. At a distal end of the extension piece is a retaining means. One way of forming the retaining means is to have another small threaded portion at the distal end of the extension piece.

An advantage of the present invention is that a user can change his oil without having to completely separate the oil pan bolt from the oil pan, thereby reducing the contact of used oil with the user's hands, and reducing greatly the possibility of misplacing the bolt.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
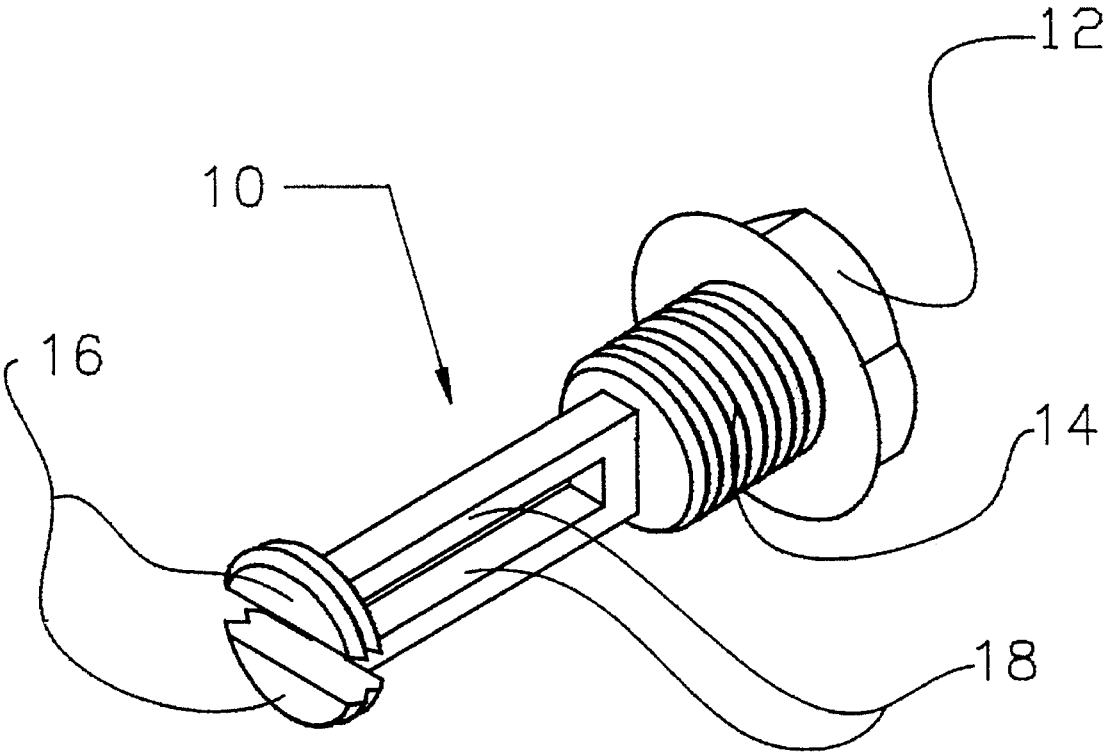
FIG. 1 is a perspective view of the oil pan bolt of the present invention.
Figure 2:
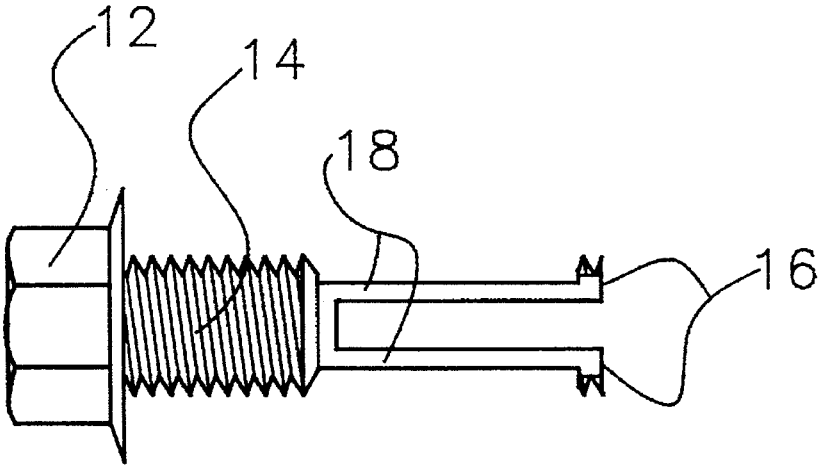
FIG. 2 is a side view of the bolt.

The present invention is an oil pan bolt with retaining means 10. Referring first to FIGS. **1–2*b*, the bolt 10 comprises a standard bolt head with a sealing flange 12. The bolt 10 further includes a threaded portion 14. At a distal end of the threaded portion 14 an extension piece 18 is secured. At a distal end of the threaded portion is a retaining means 16**.

In a first preferred embodiment, the retaining means 16 is a disk shaped member with a diameter equal to that of the threaded portion 14. The retaining means includes threads on its outer perimeter. The user inserts the retaining means 16 into a drain hole in an oil pan, and screws the bolt 10 in so that the retaining means 16 passes the wall of the oil pan. The bolt 10 may then be freely moved along a travel path impeded at a first end by the retaining means 16 and at a second end by the threaded portion 14. In this position, oil may be drained from the oil pan without completely removing the pan bolt. To seal the drain hole, the user simply screws the threaded portion 14 into the drain hole.

While the preferred embodiment utilizes a threaded disk member as the retaining means, various constructions will readily achieve the desired results. FIGS. 3–6 show some alternate embodiments of the retaining means and the extension piece.

Figure 3:
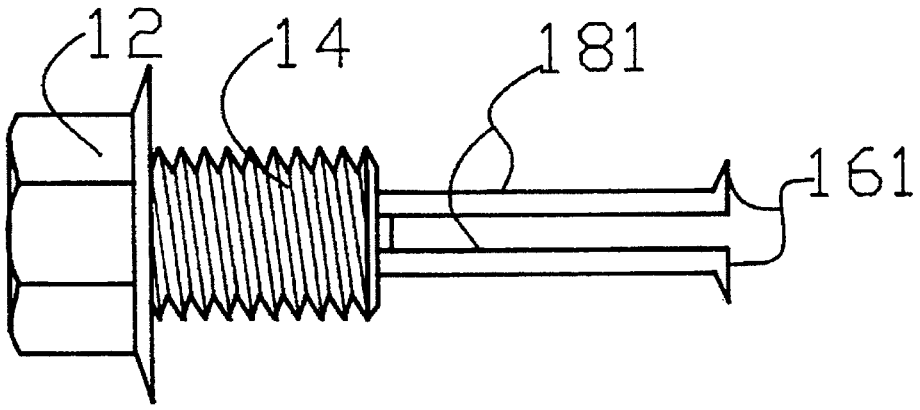
FIGS. 3–6 depict alternate extension pieces and retaining means.
Figure 4:
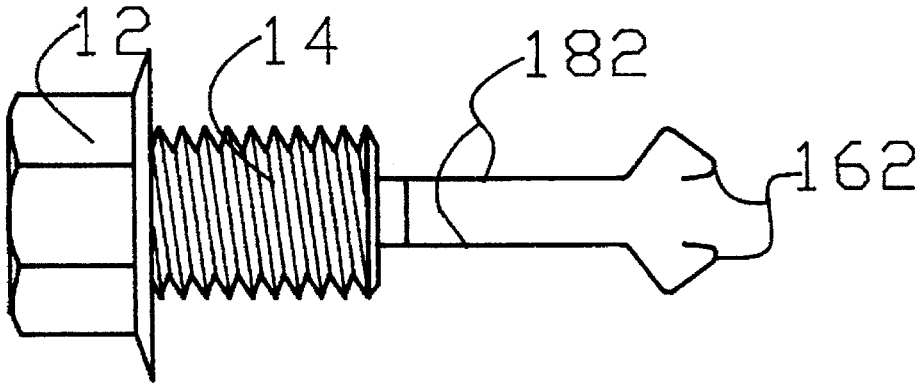
Figure 5:
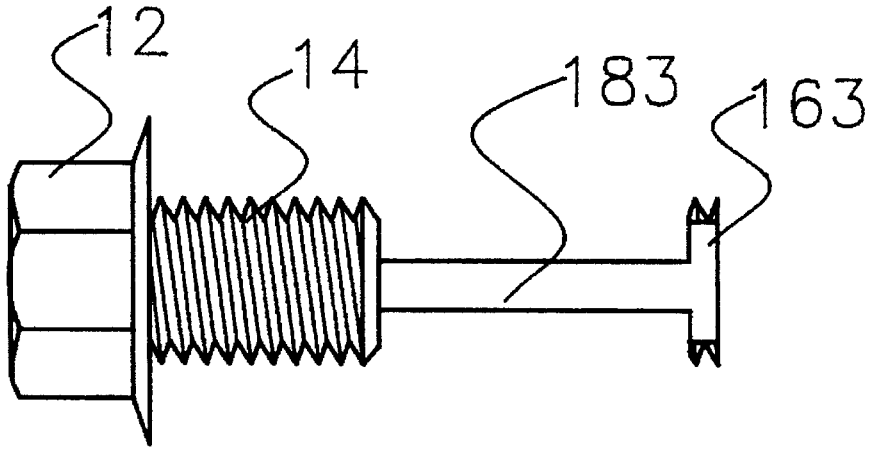
Figure 6:
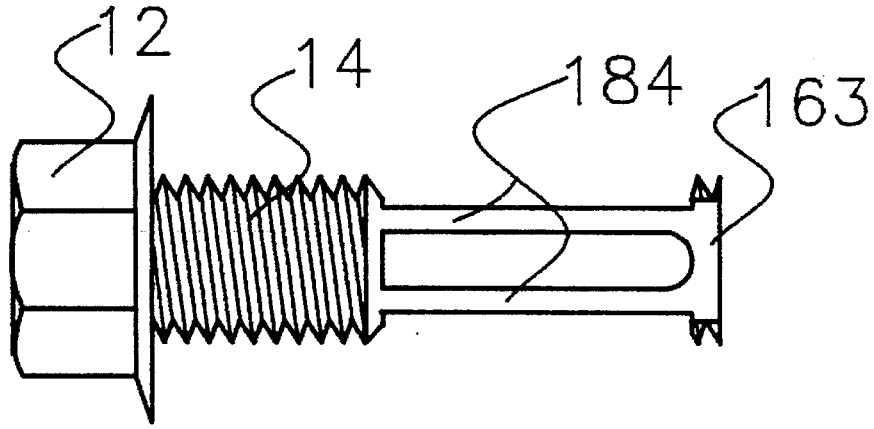

FIG. 3 shows an extension piece 181 that culminates in a wedge-shaped retaining means 161. FIG. 4 shows an extension piece 182 and retaining means 162 that are thin and therefore flexible. This allows a user to compress the retaining means 162 and the extension piece 182 so that the retaining means 162 can be forced through the drain hole, where it will expand so that it will not fall out of the oil pan. FIG. 5 shows a single bar extension piece 183 utilizing a threaded retaining means 163. FIG. 6 illustrates a double bar extension piece 184 with a threaded retaining means 164.

It is clear that the extension piece and retaining means of the present invention may take on many conformations. The critical elements are that the retaining means is inhibited from passing out of the oil pan once it has been inserted, that is to say, the effective diameter of the retaining element is equal to or exceeds that of the drain hole, and that the extension piece provide sufficient leeway for oil to drain from the pan with the bolt loosely in place.

Figure 7:
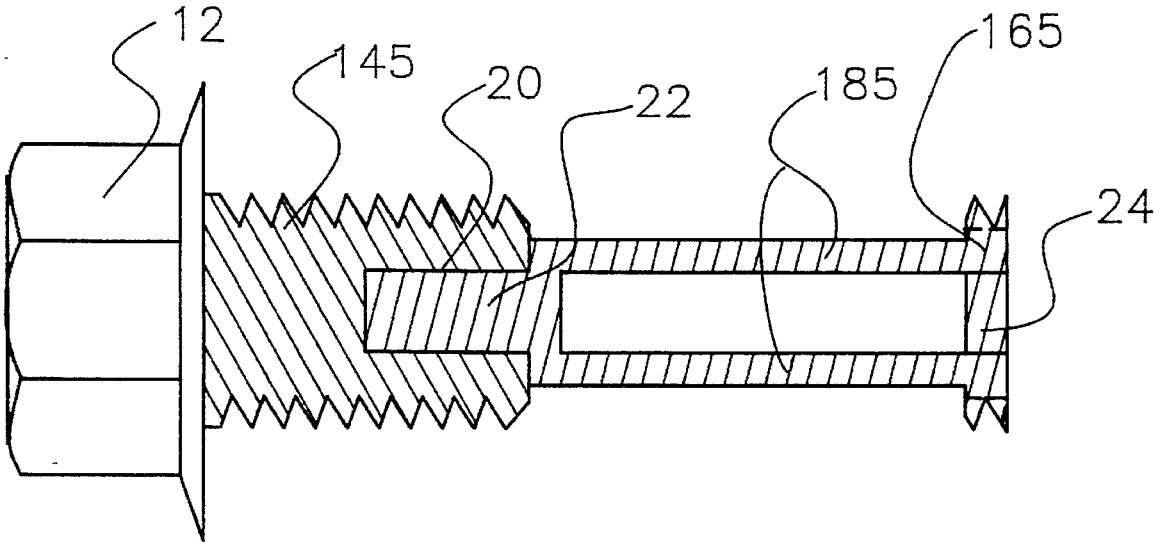
FIG. 7 is a cross section of an alternate means of securing the extension piece.

The extension piece 18 may either be integral to the threaded portion 14 of the bolt 10, or it may be secured to the threaded portion. As is illustrated in FIG. 7, if an extension piece 185 is to be secured to a threaded portion 145, the threaded portion 145 includes a socket 20 to receive a securing pin 22 on an attaching end of the extension piece 185. The attaching pin 22 is securely fixed in the socket 20 so that the extension piece 185 is securely fixed to the threaded portion 145 of the bolt.

As may also be seen in FIG. 7, the retaining means 165 may include a magnetic cross piece 24 to further ensure that the bolt remains secured to the oil pan.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. An oil pan bolt comprising:

a standard bolt head with a sealing flange, a threaded portion extending from said bolt head, an extension piece extending from said threaded portion, and a disk shaped retaining means including threads at a distal end of said extension piece; wherein said retaining means has an effective diameter at least as large as that of an oil pan drain hole such that when said retaining means is inserted through said drain hole, said retaining means prevents said bolt from falling out of said drain hole, in spite of pressure applied from draining oil, and said extension piece allows sufficient leeway when said bolt is supported by said retaining means for oil to flow through said drain hole.

2. The oil pan bolt of claim 1 wherein:

said extension piece is integral to said threaded portion.

3. The oil pan bolt of claim 1 wherein:

said threaded portion includes a socket to receive an attaching pin of said extension piece, said attaching pin is securely fixed in the socket, thereby securely fixing said extension piece to said threaded portion.

4. An oil pan bolt comprising:

a standard bolt head with a sealing flange, a threaded portion extending from said bolt head, an extension piece extending from said threaded portion, and a retaining means at a distal end of said extension piece, said retaining means includes a magnetic cross piece; wherein said retaining means has an effective diameter at least as large as that of an oil pan drain hole such that when said retaining means is inserted through said drain hole, said retaining means prevents said bolt from falling out of said drain hole, in spite of pressure applied from draining oil, and said extension piece allows sufficient leeway when said bolt is supported by said retaining means for oil to flow through said drain hole.

5. The oil pan bolt of claim 4 wherein:

said extension piece is integral to said threaded portion.

6. The oil pan bolt of claim 4 wherein:

said threaded portion includes a socket to receive an attaching pin of said extension piece, said attaching pin is securely fixed in the socket, thereby securely fixing said extension piece to said threaded portion.

* * * * *